US009743792B1

(12) United States Patent
Xu

(10) Patent No.: US 9,743,792 B1
(45) Date of Patent: Aug. 29, 2017

(54) SIMPLE CURTAIN HOOK

(71) Applicant: Min Xu, Guangzhou (CN)

(72) Inventor: Min Xu, Guangzhou (CN)

( * ) Notice: Subject to any disclaimer, the term of this patent is extended or adjusted under 35 U.S.C. 154(b) by 0 days.

(21) Appl. No.: 15/457,581

(22) Filed: Mar. 13, 2017

(30) Foreign Application Priority Data

Jan. 4, 2017 (CN) ..... 2017 2 0007030 U

(51) Int. Cl.
*E05D 15/00* (2006.01)
*A47H 13/04* (2006.01)

(52) U.S. Cl.
CPC ..... *A47H 13/04* (2013.01)

(58) Field of Classification Search
CPC . Y10T 16/353; Y10T 16/354; Y10T 16/3543; Y10T 16/376; Y10T 16/379; Y10T 16/35; Y10T 16/373; E05Y 2201/684; E05Y 2201/644; E05Y 2201/646; E05Y 2201/668; E05Y 2900/108; E05Y 2900/114; E05D 15/06; E05D 15/0652; E05D 15/0626; E05D 15/063; E05D 15/0643; E05D 15/0647; E05D 15/165; E05D 15/0215; A47H 1/02; A47H 1/04; A47H 1/10; A47H 1/13; A47H 1/102; A47H 1/104; A47H 1/124; A47H 2001/0215; A47H 2001/021; A47H 2001/047; A47H 515/00; A47H 515/02; A47H 515/04; A47H 23/00; A47H 5/02; A47H 5/03; A47H 5/0325; A47H 5/032; A47H 13/00; A47H 13/02; A47H 13/04; A47H 15/00; A47H 15/02; A47H 15/04
See application file for complete search history.

(56) References Cited

U.S. PATENT DOCUMENTS 272,772 A * 2/1883 Rieger ..... E04G 21/30 160/368.1
3,561,037 A * 2/1971 Hachtel ..... A47H 13/04 16/87.2
3,596,306 A * 8/1971 Wachenheimer ..... A47H 13/02 16/87.2
3,806,995 A * 4/1974 Gass ..... A47H 13/04 24/346
5,291,632 A * 3/1994 Akashi ..... A47H 13/04 16/87.2
5,421,059 A * 6/1995 Leffers, Jr. ..... A47H 1/104 16/87.4 R
5,544,387 A * 8/1996 Yamamoto ..... A47H 13/00 16/87.2

(Continued)

*Primary Examiner* — Chuck Mah
(74) *Attorney, Agent, or Firm* — Muncy, Geissler, Olds & Lowe, P.C.

(57) ABSTRACT

The utility model provides a simple curtain hook comprising an air bag, a main body rack, engaging teeth, a blocking bar and a hook. The engaging teeth are arranged on a lower end face of the main body rack, which design realizes the connection with a curtain fabric to prevent the hook from falling off and improve a film connection effect. The blocking bar is fixed at a right end of the main body rack, the hook is mounted above the blocking bar, and a left part of the hook is assembled at a middle position of an upper end of the air bag, which design realizes the self-locking of the hook, facilitates disassembly and reduces labor intensity. The simple curtain hook of the utility model is convenient to use and disassemble, reduces labor intensity and has high firmness.

6 Claims, 1 Drawing Sheet

(56) References Cited

U.S. PATENT DOCUMENTS

| | | | | | |
|---|---|---|---|---|---|
| 5,586,595 | A * | 12/1996 | Takizawa | A47H 13/14 | 16/87.2 |
| 5,615,461 | A * | 4/1997 | Tominaga | A47H 13/04 | 160/330 |
| 6,047,441 | A * | 4/2000 | Moorman | A44B 13/0088 | 16/2.1 |
| 6,382,297 | B1 * | 5/2002 | Takizawa | A44B 18/0049 | 160/330 |
| 7,228,600 | B1 * | 6/2007 | Selby | F16B 45/02 | 24/265 H |
| 8,875,770 | B1 * | 11/2014 | Martin | A47H 13/04 | 16/87.2 |
| 2006/0260040 | A1 * | 11/2006 | Schmidt | A47K 3/38 | 4/558 |
| 2007/0136985 | A1 * | 6/2007 | Prabhakar | A47K 3/38 | 16/87.2 |
| 2008/0148526 | A1 * | 6/2008 | Garcia | A47H 1/02 | 16/87 R |
| 2010/0125987 | A1 * | 5/2010 | Barkun | A47H 13/00 | 24/716 |
| 2010/0319858 | A1 * | 12/2010 | Freedland | A47H 1/02 | 160/127 |
| 2012/0198655 | A1 * | 8/2012 | Lapping | E04H 15/18 | 16/91 |

* cited by examiner

SIMPLE CURTAIN HOOK

FIELD OF THE UTILITY MODEL

The utility model belongs to the field of hook equipment and relates to a simple curtain hook.

BACKGROUND OF THE UTILITY MODEL

In the prior art, a curtain is a drape hung on a window for shading or adjusting indoor illumination, which is made of fabrics, bamboo, reed, linen, yarn, plastics, metallic materials, etc. With the development of curtains, curtains have become an indispensable indoor decoration with a perfect balance between the functionality and the decoration. There are various types of curtains, and commonly used curtains include roller blinds, window screens, vertical curtains, roman curtains, bamboo curtains, aluminum shutters, drapery curtains, screen window gauze, seamless sheer curtains, window blinds, soundproof curtains and vertical movable curtains. Curtains are classified as simple curtains, track-type curtains and box-type curtains, wherein the simple curtains are fixed by hooks.

An existing hook is fixed to a curtain fabric by an adhesive and therefore the hook often falls off and is not firmly connected. An existing curtain fabric hook is a spring self-locking hook to prevent the hook from falling off, but an operator needs to press a movable rod with greater force to open the hook, which increases labor intensity and disassembly difficulty.

SUMMARY OF THE UTILITY MODEL

For the disadvantages of the prior art, an object of the utility model is to provide a simple curtain hook so as to solve the problems mentioned in the above background section. The simple curtain hook of the utility model is convenient to use and disassemble, reduces labor intensity and has high firmness.

To achieve the above object, the utility model is realized by the following technical solution: a simple curtain hook comprises an air bag, a main body rack, engaging teeth, a blocking bar and a hook, wherein the air bag is mounted on the main body rack, the engaging teeth are arranged on a lower end face of the main body rack, the blocking bar is fixed at a right end of the main body rack, the hook is mounted above the blocking bar, and a left part of the hook is assembled at a middle position of an upper end of the air bag.

Further, an inflation opening is mounted on the air bag.

Further, the air bag is connected with the main body rack by glue.

Further, barbs are machined on the engaging teeth.

Further, the hook is provided with anti-skid streaks.

Further, the hook is provided with an anti-abrasion sleeve.

The utility model has the following beneficial effects: a simple curtain hook is provided, wherein the design of a main body rack and engaging teeth in the utility model realizes the connection with a curtain fabric to solve the problems that an existing hook is fixed to a curtain fabric by an adhesive and therefore the hook often falls off and is not firmly connected, etc.; and the design of an air bag, a blocking bar and a hook in the utility model realizes the self-locking of the hook and facilitates disassembly to solve the problems that an existing curtain fabric hook is a spring self-locking hook to prevent the hook from falling off, but an operator needs to press a movable rod with greater force to open the hook, which increases labor intensity and disassembly difficulty, etc.

The design of an inflation opening allows the air bag to be inflated; the air bag is connected with the main body rack by glue, which design facilitates the replacement of the air bag by an operator; the design of barbs further improves a fastening effect; the design of anti-skid streaks facilitates the use of the hook by an operator; and the design of an anti-abrasion sleeve improves the service life of the hook. The simple curtain hook of the utility model is convenient to use and disassemble, reduces labor intensity and has high firmness.

BRIEF DESCRIPTION OF THE DRAWINGS

Other features, objects and advantages of the utility model will become more apparent by reading the detailed description of non-limiting embodiments made with reference to the following accompanying drawings.

In the Figures: 1—air bag; 2—main body rack; 3—engaging tooth; 4—blocking bar; 5—hook.

DETAILED DESCRIPTION OF THE UTILITY MODEL

In order that the technical means, inventive features, objects and efficacies of the utility model are readily understood, the utility model will be further described below in conjunction with particular embodiments.

Figure 1:
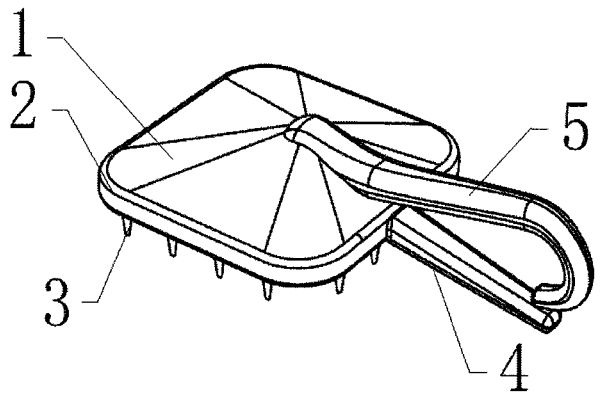
FIG. 1 is a schematic structural view of a simple curtain hook of the utility model.
Figure 2:
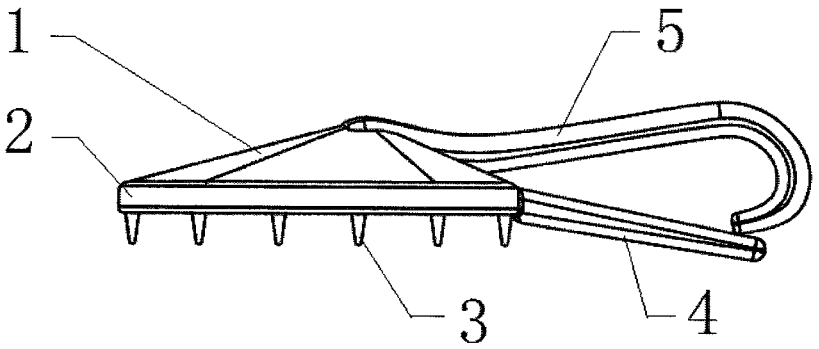
FIG. 2 is a front view of a simple curtain hook of the utility model.

Referring to FIGS. 1 and 2, the utility model provides a technical solution: a simple curtain hook comprises an air bag 1, a main body rack 2, engaging teeth 3, a blocking bar 4 and a hook 5, wherein the air bag 1 is mounted on the main body rack 2, the engaging teeth 3 are arranged on a lower end face of the main body rack 2, the blocking bar 4 is fixed at a right end of the main body rack 2, the hook 5 is mounted above the blocking bar 4, and a left part of the hook 5 is assembled at a middle position of an upper end of the air bag 1.

An inflation opening is mounted on the air bag 1; the air bag 1 is connected with the main body rack 2 by glue; barbs are machined on the engaging teeth 3; the hook 5 is provided with anti-skid streaks; and the hook 5 is provided with an anti-abrasion sleeve.

The utility model is specifically implemented as follows: when in use, an operator first checks whether the simple curtain hook of the utility model has defects, if yes, the hook cannot be used and then a repairman is notified, if not, the hook can be used; and before use, the operator first inserts the engaging teeth 3 into an upper edge of a curtain fabric, which design realizes the connection of the simple curtain hook of the utility model with the curtain fabric to solve the problems that an existing hook is fixed to a curtain fabric by an adhesive and therefore the hook often falls off and is not firmly connected, etc.

When the curtain fabric needs to be hung, the operator presses down the left part of the hook 5, the hook 5 moves down to press the air bag 1, then the left part of the hook 5 continues to move down when blocked by the main body rack 2, a right part of the hook 5 moves up due to the lever principle, the hook 5 is opened, then the simple curtain hook of the utility model is hung by the hook 5, then the hook 5 is loosened, and the air bag 1 is automatically filled with air to drive the hook 5 and the blocking bar 4 to return to a closed state, thereby hanging the curtain fabric, which design realizes the self-locking of the hook 5 and facilitates disassembly to solve the problems that an existing curtain fabric hook is a spring self-locking hook to prevent the hook from falling off, but an operator needs to press a movable rod with greater force to open the hook, which increases labor intensity and disassembly difficulty, etc.

The basic principles, main features and advantages of the utility model have been illustrated and described above, but for those skilled in the art, the utility model is apparently not limited to the details of the above exemplary embodiments, and the utility model can be implemented in other specific forms without departing from the spirit or basic features of the utility model. Accordingly, anyway, the embodiments should be considered to be exemplary and non-limiting. The scope of the utility model is defined by the appended claims rather than the above description, thus all changes falling within the meaning and scope of equivalent conditions of the claims are intended to be included in the utility model. Any reference numeral in the claims should not be regarded as limiting the claims involved.

In addition, it should be understood that the present description is described in accordance with embodiments, but not every embodiment only contains one independent technical solution, and such narrative manner of the present description is only for the sake of clarity, thus those skilled in the art should regard the present description as a whole, and the technical solutions in various embodiments may also be appropriately combined to form other embodiments that may be understood by those skilled in the art.

The invention claimed is:

1. A simple curtain hook, comprising an air bag (1), a main body rack (2), engaging teeth (3), a blocking bar (4) and a hook (5), characterized in that: the air bag (1) is mounted on an upper surface of the main body rack (2), the engaging teeth (3) are arranged on a lower surface of the main body rack (2), the blocking bar (4) is fixed at a side end of the main body rack (2) to block an opening of said hook, the hook (5) is positioned above the blocking bar (4), and one end part of the hook (5) is assembled at a middle position of an upper end of the air bag (1).

2. The simple curtain hook according to claim 1, characterized in that: an inflation opening is mounted on the air bag (1).

3. The simple curtain hook according to claim 1, characterized in that: the air bag (1) is connected with the main body rack (2) by glue.

4. The simple curtain hook according to claim 1, characterized in that: barbs are machined on the engaging teeth (3).

5. The simple curtain hook according to claim 1, characterized in that: the hook (5) is provided with anti-skid streaks.

6. The simple curtain hook according to claim 1, characterized in that: the hook (5) is provided with an anti-abrasion sleeve.

* * * * *